US005479662A

United States Patent [19]

Runco

[11] Patent Number: 5,479,662

[45] Date of Patent: Jan. 2, 1996

[54] PRIVACY COVERING FOR NURSING MOTHERS

[76] Inventor: Teri Runco, 12 Stafford Ct., Sterling, Va. 20165

[21] Appl. No.: 336,220

[22] Filed: Nov. 7, 1994

[51] Int. Cl.[6] ..... A41D 1/00; A41D 1/20; A41D 1/22

[52] U.S. Cl. ..... 2/104; 2/48; 2/49.1

[58] Field of Search ..... 2/46, 48, 49.1, 2/49.2, 49.3, 49.4, 49.5, 50, 51, 52, 104, 105, 106, 88, 69, 69.5, 2, 1; 5/494

[56] References Cited

U.S. PATENT DOCUMENTS

| | | | |
|---|---|---|---|
| 2,517,357 | 8/1950 | Schlegel, Jr. | 2/49.2 |
| 2,655,659 | 10/1953 | Swearingen | 2/52 |
| 2,794,985 | 6/1957 | Brennish | 2/50 |
| 2,884,638 | 5/1959 | Ream | 2/52 |
| 4,631,754 | 12/1986 | Ryan . | |
| 4,651,349 | 3/1987 | Heiler | 2/104 |
| 4,924,528 | 5/1990 | Trombetti-Dickens . | |
| 4,989,268 | 2/1991 | Stolhand . | |
| 5,038,411 | 8/1991 | St. Armand . | |
| 5,259,068 | 11/1993 | Carroll . | |

*Primary Examiner*—Jeanette E. Chapman
*Attorney, Agent, or Firm*—Sixbey, Friedman, Leedom & Ferguson; David S. Safran

[57] ABSTRACT

A privacy covering for nursing mothers in which an arcuately curved, resiliently flexible flat strip is hemmed into a central portion of the upper edge of a blanket or sheet type covering. A neck strap is attached to the upper edge of the covering adjacent one end of the strip and carries one-half of hook and loop self-adhering detachable closure (i.e., a VELCRO® closure) for securement with the other half of self-adhering detachable closure which is attached to the covering adjacent the opposite end of the strip. The rectangular cross section of the strip shape has sufficient inherent rigidity to prevent flexing thereof in the plane of the covering material, i.e., vertical sagging, and to hold the top edge of the covering outwardly bowed in a direction normal to the plane of the covering material i.e., in a generally horizontal direction, when worn about a nursing mother's neck. In this way, a one size fits all covering can be produced, which can be comfortably worn and easily put on and taken off; yet, the covering possesses an excellent screening capacity for any size person while still providing ample ventilation for the child and an excellent view of the child for the mother.

6 Claims, 1 Drawing Sheet

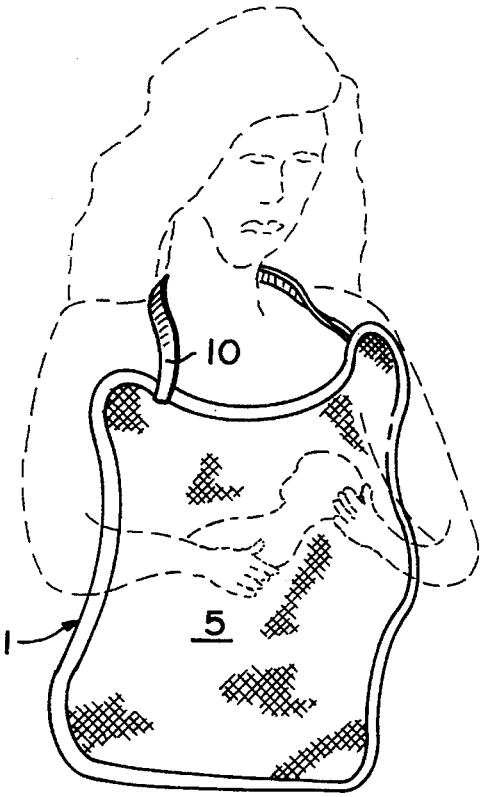
FIG. 1
FIG. 2
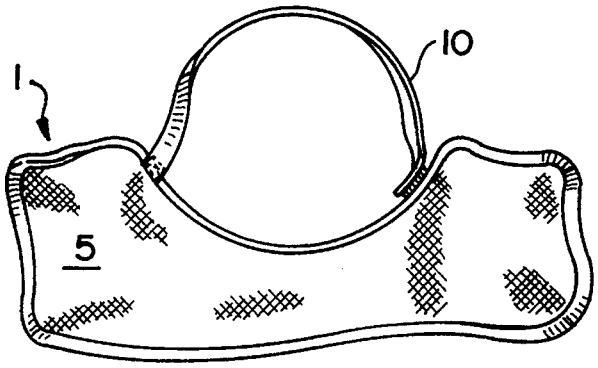
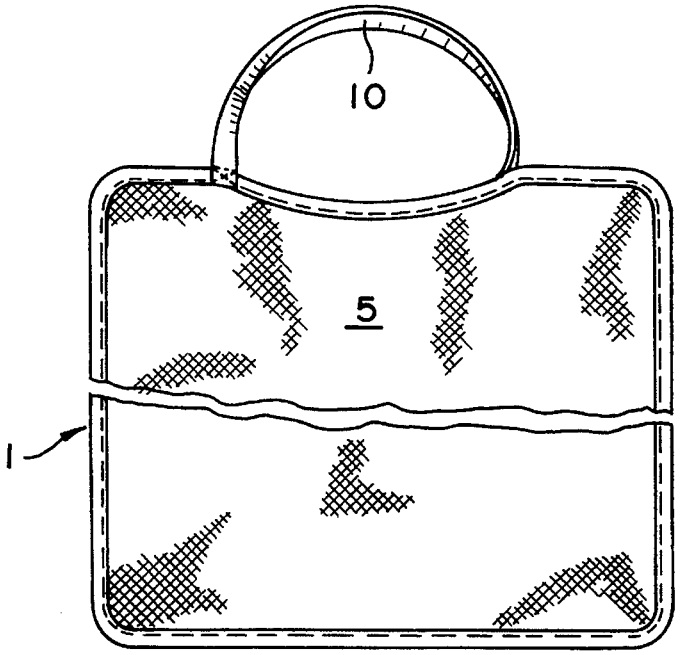
FIG. 3
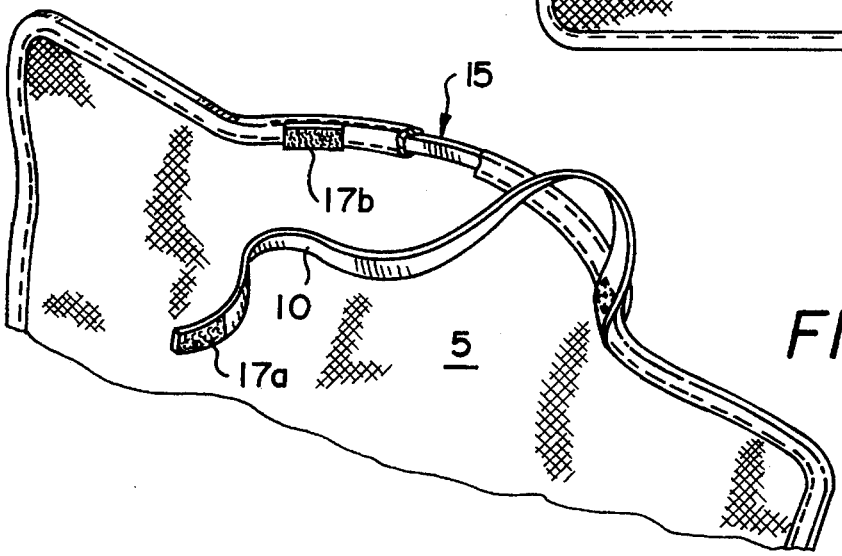
FIG. 4

PRIVACY COVERING FOR NURSING MOTHERS

BACKGROUND OF THE INVENTION

1. Field of the Invention

The present invention relates to covers in the form of a blanket or bib which provides a privacy shield for use by a mother when nursing her infant in a public place.

2. Description of Related Art

Numerous covers in the form of a bib, blanket or other covering for the upper torso of a woman are known for use in shielding a mother's breast from view when circumstances require that she nurse her child in a place where she cannot, or it is inconvenient to, retreat from view. While conventional blankets and diapers have been used by mothers for this purpose, a blanket or diaper draped over her should will not enable the mother to view her nursing child nor will it provide adequate ventilation for the child. Also, a mother using an unsecured blanket or bib runs the risk that it will slip off at any time.

As a result, various types of securable privacy coverings have been developed. These privacy coverings have either been securable at the mother's shoulder (U.S. Pat. Nos. 4,964,172; 4,989,268; and 5,038,411) or around her neck in the manner of a bib (for example, U.S. Pat. Nos. 4,631,754; 4,716,597; 4,924,528; 4,987,612; 5,034,999; and 5,259,068). The first type provide only a limited coverage area, posing problems if the child is to be nursed from both sides due to the need to remove and remount the shield at the opposite shoulder when switching sides, and their holding mechanisms (e.g., a hook-like member) could be uncomfortable if too small or fall off if too big.

On the other hand, bib type privacy shields have possessed other deficiencies. For example, if secured around the neck of the mother, a bib type covering has a tendency to drape itself over the child and if large enough to provide adequate coverage of the mother's upper torso, provides little ventilation to the child and inhibits the ability of the mother to view her child. To combat this tendency, various techniques have been employed. In the case of U.S. Pat. No. 4,631,754, the nursing scarf disclosed therein is tied so as to produce a neck opening substantially larger than the wearer's neck and the upper margin of the scarf is pleated, to provide an opening through which the mother may view her nursing child. However, in practice, the pleats have little structural strength and with a opening that is large enough to insure the ability to view the child, it would be difficult to arrange the scarf so as to achieve both sufficient screening of the nursing child relative to onlookers and visibility for the mother.

In U.S. Pat. No. 4,716,597, a nursing garment is disclosed which is in the form of a poncho that is worn by placing it over the head of the mother. In an attempt to enable the mother to be able to view her nursing child, a rigid hoop is hemmed into the neck opening. However, because the rigid hoop must be large enough to allow the mother's head to pass through it and there is no means to hold it in a horizontal orientation, it has a tendency to hang against the mother's chest, effectively blocking the visibility of the child. Moreover, such a poncho type garment is large and cumbersome to carry around and creates the problem that the mother's hair will be placed in a condition of disarray as a result of pulling it on and off, thereby making its use undesirable.

These problems are solved, at least in part, with the nursing cover of U.S. Pat. No. 5,259,068, which discloses a bib type nursing cover which is secured about the mothers neck using an adhesive closure of the VELCRO® type, so that it can be easily be put on without her hair style being disturbed, and viewing slits are provided by omission of stitching between upper and lower panels of the cover at a location above breast height and long enough to provide a clear view but not so long as to produce too much gapping, 9 inches being given as a suitable length. However, such a multipanel garment is more expensive to produce than a single panel one. Also, what might be a suitable height and length for the slits for one person, for example, a short, thin woman, very likely would be unsuitable for another, for example, a tall buxom one, thereby necessitating production of the nursing cover in sizes, further increasing production costs.

SUMMARY OF THE INVENTION

In view of the foregoing, it is the object of the present invention to provide a privacy covering for use by a mother when nursing her infant in a public place which allows easy viewing and adequate ventilation of the child without compromising screening efficiency, while still being easy to put on and take off, and simple and inexpensive to manufacture.

This object is achieved in accordance with a preferred embodiment of the invention in which an arcuately curved, resiliently flexible fiat strip is hemmed into a central portion of the upper edge of a blanket or sheet type coveting. A neck strap is attached to the upper edge of the covering adjacent one end of the strip and carries one-half of hook and loop self-adhering detachable closure (i.e., a VELCRO® closure) for securement with the other half of self-adhering detachable closure which is attached to the covering adjacent the opposite end the strip. The rectangular cross section of the strip shape has sufficient inherent rigidity to prevent flexing thereof in the plane of the covering material, i.e., vertical sagging, and to outwardly bow the top edge of the covering in a direction normal to the plane of the covering material i.e., in a generally horizontal direction, when worn about a nursing mother's neck. In this way, a one size fits all covering can be produced, which can be comfortably be worn and easily put on and taken off; yet, the covering possesses an excellent screening capacity for any size person while still providing ample ventilation for the child and an excellent view of the child for the mother.

These and further objects, features and advantages of the present invention will become apparent from the following description when taken in connection with the accompanying drawings which, for purposes of illustration only, show a single embodiment in accordance with the present invention.

BRIEF DESCRIPTION OF THE DRAWINGS

FIG. 1 shows the privacy covering as worn by a nursing mother;

FIG. 2 is a top view of the privacy covering when worn as in FIG. 1;

FIG. 3 is a frontal view of the privacy covering; and

FIG. 4 is a partially broken away view of the top edge portion of the privacy covering.

DETAILED DESCRIPTION OF THE PREFERRED EMBODIMENT

With reference to the drawings, the privacy covering 1 in accordance with the preferred embodiment of the invention comprises a blanket or sheet type covering 5 formed of a soft, air permeable fabric material to which a neck strap 10 is attached. An arcuately curved, resiliently flexible flat strip 15, of metal or plastic, is hemmed into a central portion of the upper edge of covering 5 (FIG. 4).

One end of neck strap 10 is attached to the upper edge of the covering adjacent one end of the strip 15 and the opposite, free end of the neck strap 10 carries a first element 17*a* of a hook and loop self-adhering detachable closure (i.e., a VELCRO® closure). The other element 17*b* of the self-adhering detachable closure is attached to the covering 5 adjacent the opposite end of strip 15. In this way, the covering can be easily put on and taken off by wrapping/unwrapping the neck strap about the mother's neck and attaching/detaching element 17*a* to/from element 17*b*.

The rectangular or other cross section of the strip 15, together with the strength of the material of which it is made, give it sufficient inherent rigidity to prevent significant flexing thereof in the plane of the covering 5, i.e., vertical sagging when held at its ends. Additionally, the strip 15 will hold an unstressed shape in which the strip 15 and the top edge of the covering 5 are frontally or outwardly bowed away from the mother's chest in a direction normal to the plane of the covering material i.e., in a generally horizontal direction (as most apparent from FIGS. 2 & 4), despite being suspended from, the mother's neck.

As apparent from FIG. 1, the covering 5 can be made to have an area that possesses an excellent screening capacity for any size person while bowing of the strip 15, provides ample ventilation for the child. Furthermore, an excellent view of the child for the mother results from the bowing of the top edge of the covering 5 away from the mother's chest due to the curvature of the strip 15. The neck strap can hold the covering 5 high enough to insure sufficient privacy for any woman and since the top edge of the covering is always below the top of her shoulders, the problem of a hoop rocking or sliding on the mother's shoulders is avoided, so that she can always look down into the gap formed between her chest and the top of the covering 5 that is created by the strip 15.

Since the covering is formed of a single sheet of flat material without openings pockets or the like, apart from providing a hem with the strip 15 and attaching of the neck strap 15, no other assembly steps are required. The covering 5 can be folded and packaged compactly, the resilient flexibility of strip 15 allowing it to be held either essentially flat or substantially folded over for packaging and storage purposes, and without affecting its ability to springing back to its bowed shape for use.

While only a single embodiment in accordance with the present invention has been shown and described, it should be understood that the invention is not limited thereto, and is susceptible to numerous changes and modifications as known to those skilled in the art. For example, instead of using a neck strap 10 which is permanently attached to the covering 5 at one end and is detachably securable to the covering 5 at an opposite end, a pair of straps could be used, one running from each end of strip 15, these straps being tied, snapped together, or otherwise secured behind the mother's neck. Therefore, this invention is not limited to the details shown and described herein, and includes all such changes and modifications as are encompassed by the scope of the appended claims.

I claim:

1. A privacy covering for nursing mothers comprising a panel of fabric of a height and width sufficient to cover at least a chest region between a mother's shoulders and lap and a neck strap for detachably securing the panel so as to hang from the mothers neck; wherein a resiliently flexible strip is fastened running along a central portion of an upper edge of the covering, said being strip being resiliently flexible for bending about a line running along said panel in a direction normal to the upper edge thereof but being resistant to bending within a plane containing said line; wherein said strip has an arcuately curved, unstressed configuration acting to bow the central portion of the upper edge of said panel away from the mother's chest when hanging loosely therefrom; and wherein said neck strap, when secured about the neck of the mother, runs from a position adjacent a first end of said strip to a position adjacent a second end of said strip, said positions being located laterally inwardly from opposite ends of said upper edge of the covering.

2. A privacy covering for nursing mothers according to claim 1, wherein said strip is a flat strip of rectangular cross section which is hemmed into the upper edge of the covering.

3. A privacy covering for nursing mothers according to claim 2, wherein one end of the neck strap is permanently attached to the upper edge of the covering adjacent the first end of said strip and an opposite, free end of the neck strap carries a first element of a detachable closure; and wherein a second element of the detachable closure, to which said first element is securable, is attached to the upper edge of the covering adjacent the second end of said strip.

4. A privacy covering for nursing mothers according to claim 3, wherein said detachable closure is a hook and loop self-adhering detachable closure.

5. A privacy covering for nursing mothers according to claim 1, wherein one end of the neck strap is permanently attached to the upper edge of the covering adjacent the first end of said strip and an opposite, free end of the neck strap carries a first element of a detachable closure; and wherein a second element of the detachable closure, to which said first element is securable, is attached to the upper edge of the covering adjacent the second end of said strip.

6. A privacy covering for nursing mothers according to claim 5, wherein said detachable closure is a hook and loop self-adhering detachable closure.

* * * * *